US008727737B2

(12) United States Patent
Seitter

(10) Patent No.: US 8,727,737 B2
(45) Date of Patent: May 20, 2014

(54) SUBMERSIBLE PUMP SYSTEM

(75) Inventor: Larry E. Seitter, Olathe, KS (US)

(73) Assignee: Grundfos Pumps Corporation, Olathe, KS (US)

( * ) Notice: Subject to any disclaimer, the term of this patent is extended or adjusted under 35 U.S.C. 154(b) by 560 days.

(21) Appl. No.: 12/910,517

(22) Filed: Oct. 22, 2010

(65) Prior Publication Data

US 2012/0100014 A1 Apr. 26, 2012

(51) Int. Cl.
*F04B 49/06* (2006.01)
*F04B 49/08* (2006.01)

(52) U.S. Cl.
USPC ..... 417/44.2; 417/423.3

(58) Field of Classification Search
USPC ..... 417/44.2, 53, 63, 423.3
See application file for complete search history.

(56) References Cited

U.S. PATENT DOCUMENTS

| | | | | |
|---|---|---|---|---|
| 4,741,208 | A | 5/1988 | Vandevier | |
| 4,798,247 | A | 1/1989 | Deaton et al. | |
| 5,015,151 | A | 5/1991 | Snyder, Jr. et al. | |
| 5,466,127 | A | 11/1995 | Arnswald | |
| 5,580,221 | A * | 12/1996 | Triezenberg | 417/44.2 |
| 6,264,431 | B1 * | 7/2001 | Triezenberg | 417/36 |
| 6,349,765 | B1 | 2/2002 | Meyers et al. | |
| 6,585,041 | B2 | 7/2003 | Crossley | |
| 6,587,037 | B1 | 7/2003 | Besser et al. | |
| 6,695,052 | B2 | 2/2004 | Branstetter et al. | |
| 6,729,849 | B2 | 5/2004 | Fong | |
| 6,873,267 | B1 | 3/2005 | Tubel et al. | |
| 6,981,399 | B1 | 1/2006 | Nybo et al. | |
| 7,093,651 | B2 | 8/2006 | Meyers et al. | |
| 7,658,227 | B2 | 2/2010 | Fox et al. | |
| 2002/0066568 | A1 | 6/2002 | Buchanan et al. | |
| 2007/0175633 | A1 | 8/2007 | Kosmala et al. | |
| 2007/0252717 | A1 | 11/2007 | Fielder | |
| 2008/0236821 | A1 * | 10/2008 | Fielder | 166/265 |
| 2008/0262736 | A1 | 10/2008 | Thigpen et al. | |
| 2008/0306892 | A1 | 12/2008 | Crossley et al. | |
| 2009/0010783 | A1 * | 1/2009 | Appel et al. | 417/423.3 |
| 2009/0044938 | A1 | 2/2009 | Crossley et al. | |
| 2009/0162223 | A1 * | 6/2009 | Lyngholm | 417/410.1 |
| 2009/0222497 | A1 | 9/2009 | Ryan | |

* cited by examiner

*Primary Examiner* — Bryan Lettman
(74) *Attorney, Agent, or Firm* — The Small Patent Law Group, LLC

(57) ABSTRACT

A submersible pump system includes a submersible pump assembly having one or more stages of impellers and a submersible motor assembly that drives the pump assembly. The submersible pump assembly includes a motor housing, a motor within the motor housing for driving the pump assembly and a control module mounted to the motor housing for operating the motor. The control module is electrically connected to a power line and comprises a controller and a variable frequency drive driven by the controller. The controller operates the variable frequency drive to drive the motor to maintain a constant pressure output condition from the pump assembly.

32 Claims, 4 Drawing Sheets

SUBMERSIBLE PUMP SYSTEM

BACKGROUND OF THE INVENTION

The subject matter herein relates generally to submersible pump systems, and more particularly, to control systems for submersible pump systems.

Submersible pump systems typically include a submersible pump assembly and a motor assembly for driving the pump assembly. The pump assembly and motor assembly are inserted in a bore-hole or storage tank. Piping extends between the pump assembly and point of use and the pump assembly pumps fluid to that point of use. The pump systems typically include a control device arranged in a spatially distanced manner outside the bore-hole at the surface. The control device is used to control the operation of the motor assembly. A data transmission between the motor assembly and the control device is necessary for controlling and monitoring the motor assembly and pump assembly. A power line extends from the surface down to the motor assembly for powering the motor assembly. Having a separate control device at the surface and the motor at in the bore-hole increases the number of parts making up the pump system, increasing the cost of the pump system and the difficulty of installing the pump system.

BRIEF DESCRIPTION OF THE INVENTION

In one embodiment, a submersible pump system is provided having a submersible pump assembly having one or more stages of impellers and a submersible motor assembly that drives the pump assembly. The submersible motor assembly includes a motor housing, a motor within the motor housing for driving the pump assembly and a control module mounted to the motor housing for operating the motor. The control module is electrically connected to a power line and comprises a controller and a variable frequency drive. The controller operates the variable frequency drive to drive the motor to maintain a constant pressure output condition from the pump assembly.

In another embodiment, a submersible pump system is provided having a submersible pump assembly that has one or more stages of impellers. The pump assembly has a discharge fining configured to be connected to piping. A pressure sensor measures the pressure of fluid directed through the discharge fitting into the piping and is positioned proximate to the discharge fitting. A submersible motor assembly drives the pump assembly. The motor assembly has a motor housing, a motor within the motor housing for driving the pump assembly and a control module mounted to the motor housing for operating the motor. The control module is electrically connected to a power line and is electrically connected to the pressure sensor by a sensor cable. The control module has a controller and a variable frequency drive driven by the controller based on pressure data from the pressure sensor. The controller operates the variable frequency drive to drive the motor to maintain a constant pressure output condition from the pump assembly.

Optionally, the submersible pump system may be configured to be calibrated. The pump system may include a pressure switch configured to monitor a surface pressure of a fluid in a pipe proximate to a point of use of the fluid in the pipe. A power source is provided that is shut off when a maximum pressure condition is sensed at the pressure switch. The controller is calibrated by comparing the pressure in the bore hole or storage tank sensed by the pressure sensor in the piping at a time when the power source is shut off and operating the variable frequency drive to drive the motor to maintain a constant pressure output condition from the pump assembly at a bore-hole pressure that is a fraction of the bore-hole pressure sensed when the power source is shut off.

In a further embodiment, a method is provided of operating a submersible pump system. The method includes use of a pressure switch for detecting a pressure of fluid in piping and providing a power supply to the pump motor. The pressure switch is operably coupled to the power supply to shut off the pump motor power supply when a maximum pressure value is detected at the surface at a point of use. The method also includes providing a submersible pump system having a pressure sensor, a pump assembly and a motor assembly submerged in a bore-hole or storage tank. The motor assembly has a motor and a control module for operating the motor. The control module is electrically connected to the power supply by a power line and is electrically connected to the pressure sensor by a sensor cable. The control module has a controller and a variable frequency drive driven by the controller based on pressure data from the pressure sensor. The pressure sensor may be located at the bottom of a long bore hole pipe and will measure a pressure reading which includes the weight of the fluid in the pipe above it. Due to this difference in pressure between an end use point and the physical location of the pressure sensor, a method is employed to indirectly calibrate the physical sensor setpoint pressure to match the desired end use setpoint pressure. The method includes operating the motor at increasing speed to increase a pressure provided by the pump assembly until the pressure switch shuts off the power supply and establishing a maximum pressure value by measuring a maximum pressure at the pressure sensor at a time when the power supply is shut off. The method includes determining a setpoint pressure by subtracting a predetermined offset pressure from the maximum pressure and operating the motor at the setpoint pressure to provide a constant pressure output condition from the pump assembly at the setpoint pressure.

DETAILED DESCRIPTION OF THE INVENTION

Figure 1:
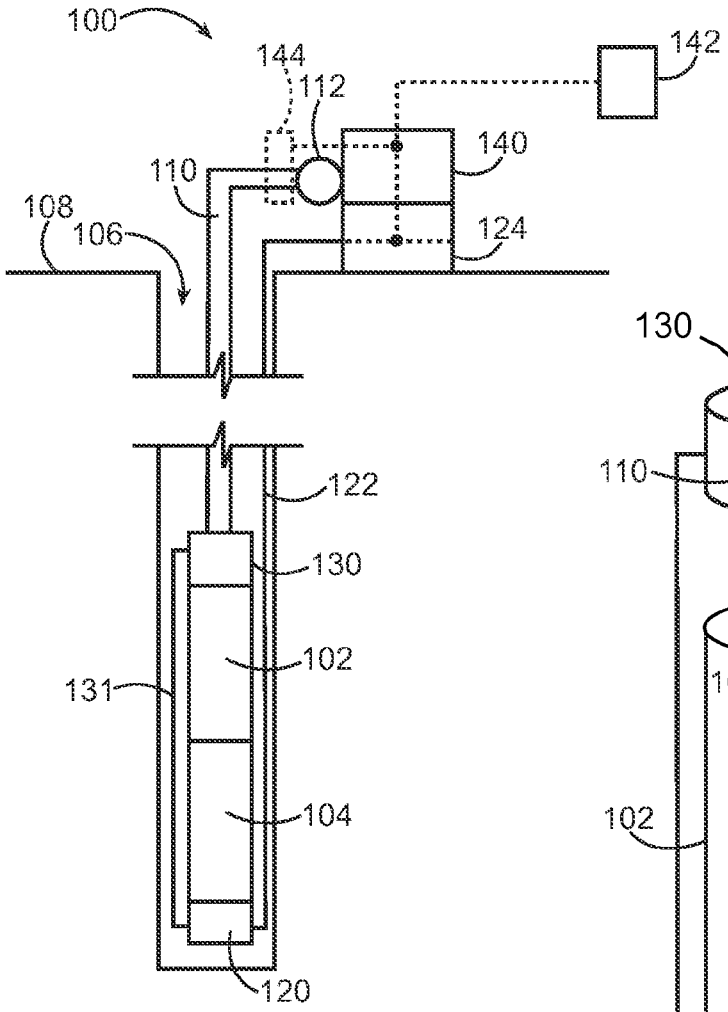
FIG. 1 illustrates a pump system formed in accordance with an exemplary embodiment.

FIG. 1 illustrates a pump system 100 formed in accordance with an exemplary embodiment. The pump system 100 includes a submersible pump assembly 102 and submersible motor assembly 104 arranged within a bore-hole 106. The bore-hole 106 extends a depth from a surface 108 and the pump assembly 102 and motor assembly 104 are lowered into the bore-hole 106 to a depth from the surface 108. The pump assembly 102 may be used in water storage tanks rather than in bore holes. Piping 110 extends from the pump assembly 102 to a use point 112 at the surface 108. The use point 112 may be within a building or other structure or located out of doors. The pump assembly 102 pumps a fluid within the bore-hole 106 to the use point 112 at the surface 108. The motor assembly 104 drives the pump assembly 102.

The motor assembly 104 includes a control module 120 having electronics and/or software that control the operation of the motor assembly 104. The control module 120 may include one or more processors, microprocessors, controllers, microcontrollers, or other logic based devices that operate based on instructions stored on a tangible and non-transitory computer readable storage medium. One or more inputs may be received by the control module 120, which define control parameters that affect the control scheme. For example, a control algorithm may be embodied in one or more processors that operate based on hardwired instructions or software applications stored on one or more memories. The memories may be or include electrically erasable programmable read only memory (EEPROM), simple read only memory (ROM), programmable read only memory (PROM), erasable programmable read only memory (EPROM), FLASH memory, a hard drive, or other type of computer memory.

Power is supplied to the control module 120 via a power line 122 that extends from a power source 124 at the surface 108. The power line 122 extends down through the bore-hole 106 to the control module 120. The power supplied by the power line 122 is used to drive the motor assembly 104. The control module 120 controls the power supply to the motor assembly 104 based on a power scheme. In an exemplary embodiment, the motor assembly 104 and control module 120 are positioned within the bore-hole 106 below the pump assembly 102. The power line 122 extends from the surface 108 down the bore-hole 106, past the pump assembly 102 to the control module 120.

A sensor module 130 is positioned within the bore-hole 106 proximate to the pump assembly 102. The sensor module 130 senses at least one water parameter of the water pumped through the piping 110 by the pump assembly 102. For example, the sensor module 130 may sense a pressure, a temperature and/or a flow rate of the water pumped through the piping 110. The sensor module 130 is positioned proximate to the pump assembly 102 such that the sensor module 130 may sense a water parameter of the water at the location where the water flows out the pump assembly 102.

In the illustrated embodiment, the sensor module 130 is mounted to the pump assembly 102. Alternatively, the sensor module 130 may be mounted to the piping 110 spaced apart from, but proximate to, the pump assembly 102. For example, a short length of piping 110 may be provided between the pump assembly 102 and the sensor module 130. The sensor module 130 may be located at any location along the piping 110, such as remote from the pump assembly 102. Optionally, the sensor module 130 is positioned above the last check valve in the piping 110, if check valves are used in the piping 110. For example, in long runs of piping 110, check valves may be used, such as at every 200 feet. The sensor module 130 may be positioned downstream of the last check valve in the piping 110. In another alternative embodiment, the sensor module 130 may be integrated into the pump assembly 102. For example, the sensor of the sensor module 130 may be housed within the pump assembly 102 for monitoring the corresponding water parameters of the water pumped through the pump assembly 102.

The sensor module 130 is communicatively coupled to the control module 120 by a sensor cable 132 extending between the sensor module 130 and the control module 120. Signals related to the sensed water parameters may be transmitted from the sensor module 130 to the control module 120 by the sensor cable 132.

The control module 120 operates the motor assembly 104 based on the signals transmitted from the sensor module 130. In an exemplary embodiment, the control module 120 operates the motor assembly 104 to maintain a constant pressure output condition from the pump assembly 102. In an exemplary embodiment, the control module 120 operates the motor assembly 104 at a variable speed in order to maintain the constant pressure output condition from the pump assembly 102. The sensor module 130 monitors a pressure of the output from the pump assembly 102 and communicates the pressure reading to the control module 120, which operates the motor of the motor assembly 104 to maintain the constant pressure output condition at the sensor module 130.

In an exemplary embodiment, the pump system 100 includes a communication module 140 spatially separated from the control module 120. In the illustrated embodiment, the communication module 140 is located at the surface 108. The communication module 140 is communicatively coupled to the control module 120, such as via powerline modems, and sends control signals to the control module 120 to change an operative parameter of the control module 120. In an exemplary embodiment, the communication module 140 is configured to be electrically connected to the power line 122 and the communication module 140 transmits data to the control module 120 via the power line 122. The control module 120 receives data transmitted via the power line 122 and uses such signals to change an operating condition of the control module 120.

The communication module 140 may include a user interface for interfacing with the pump system 100. Optionally, the user interface may be hard wired into the pump system 100 at the communication module 140. Alternatively, a remote control 142 may be provided for communicating with the communication module 140. The remote control 142 communicates with the communication module 140 wirelessly. The user may monitor operating conditions of the pump system 100 using the remote control 142. The user may input changes into the remote control 142, which may be transmitted via the communication module 140 to the control module 120. For example, the user may request an increase in pressure or a decrease in pressure using the remote control 142. Other types of information may be transmitted to the remote control 142 or transmitted by the remote control 142 to the communication module 140. In an exemplary embodiment, the remote control 142 is a dedicated remote control for operating or diagnosing the pump system 100. The remote control 142 communicates directly with the communication module 140. The remote control 142 does not require an internet connection or other network for communicating with the communication module 140. Optionally, the remote control 142 may communicate via RF communication. Alternatively, the remote control 142 may communicate by other means, such as IR communication.

In an exemplary embodiment, one or more sensor modules 144 (of the same type or of different types as the sensor module 130) may communicate directly with the communication module 140, and information from the sensor modules 144 may be transmitted to the control module 120 from the communication module 140. The sensor modules 144 may be located at the surface 108 and may sense at least one water parameter, such as pressure, temperature or flow rate. Data relating to such water parameters is transmitted to the communication module 140 and communicated by the communication module 140 to the control module 120 via the power line 122 or a dedicated sensor cable (not shown). Optionally, information from the sensor module 144 may be transmitted to the communication module 140 to control the power source 124. For example, the sensor module 144 may include a pressure switch that monitors a pressure of the water in the piping 110 at the use point 112. For example, the pressure switch may allow a maximum pressure of 60 psi before shutting off the power supply. The pump system 100 may be operated at a constant pressure condition that is less than 60 psi, such as 50 psi. Optionally, the maximum pressure allowable may be controllable or changeable by dialing up or down the shut off point of the pressure switch. The pressure switch may shut off the power source 124 when the maximum pressure is measured at the use point 112. Other types of sensors may be utilized with the sensor module 144 in alternative embodiments. The sensor module 144 may be located at different locations along the piping 110 in alternative embodiments.

Figure 2:
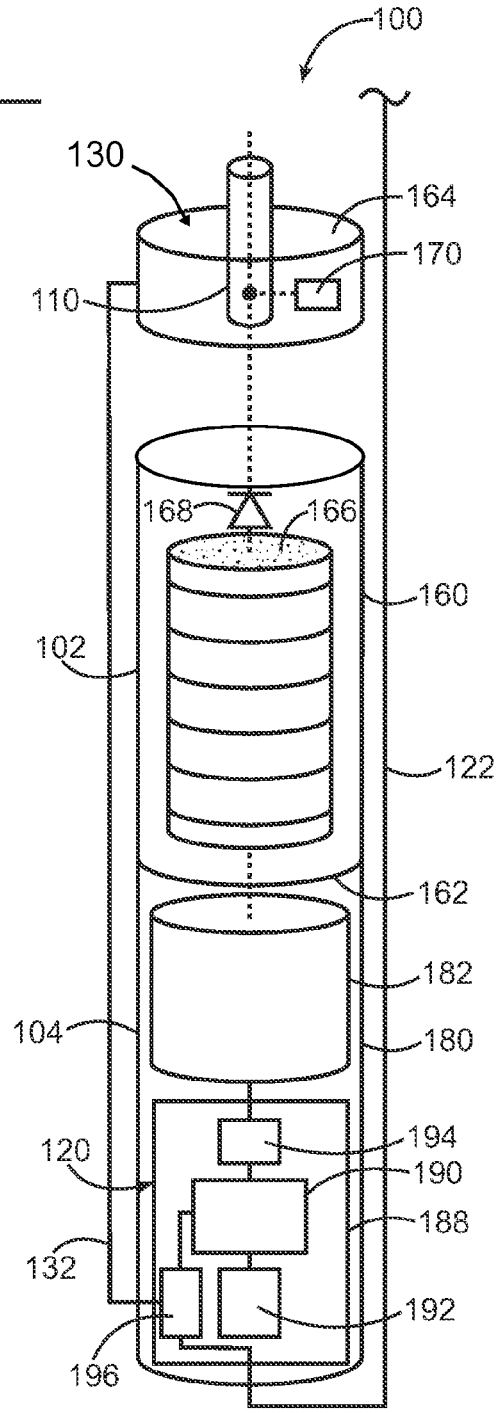
FIG. 2 is a schematic diagram of a portion of the pump system showing a pump assembly and motor assembly formed in accordance with an exemplary embodiment.

FIG. 2 is a schematic diagram of the pump assembly 102 and motor assembly 104 formed in accordance with an exemplary embodiment. The pump assembly 102 includes a pump housing 160 having an inlet end 162 and a discharge end 164. Fluid, such as water, is drawn into the pump assembly 102 through the inlet end 162. The fluid is pumped out of the discharge end 164 at an increased pressure.

In an exemplary embodiment, the pump assembly 102 is a multi-stage pump assembly having a plurality of impellers 166 arranged in multiple stages for increasing the pressure of the water pumped through the pump assembly 102. Any number of impeller stages may be provided. Optionally, the pump assembly 102 may include a single stage rather than multiple stages of impellers 166. In an exemplary embodiment, the pump assembly 102 includes a check valve 168 at the discharge end 164. The check valve 168 restricts back flow through the pump assembly 102.

The water is pumped by the pump assembly 102 from the discharge end 164 to the piping 110. Optionally, the sensor module 130 may be mounted to the discharge end 164 of the pump assembly 102. The water is pumped from the discharge end 164 through the sensor module 130 into the piping 110. Alternatively, the sensor module 130 may be positioned along the piping 110 remote from the discharge end 164. For example, a length of piping 110 may be provided between the discharge end 64 and the sensor module 130.

The sensor module 130 includes one or more sensors 170 that monitor at least one water parameter of the water pumped through the piping 110. In an exemplary embodiment, the sensor 170 constitutes a pressure sensor configured to measure a pressure of the water pumped from the pump assembly 102. Alternatively, other types of sensors may be utilized in addition to, or in place of, the pressure sensor. The sensor 170 is connected to the sensor cable 132. Data from the sensor 170 is transmitted to the control module 120 via the sensor cable 132.

The motor assembly 104 includes a motor housing 180. A motor 182 is held within the motor housing 180. The control module 120 is mounted to the motor housing 180. In an exemplary embodiment, the control module 120 is housed within the motor housing 180. Alternatively, the control module 120 may include a separate housing that is mounted to the motor housing 180 or is held within the bore-hole completely separate from the motor housing 180.

The motor 182 is operatively coupled to the pump assembly 102 for driving the pump assembly 102. For example, the motor 182 may drive a pump shaft of the pump assembly 102, which drive the impellers 166. In the illustrated embodiment the motor 182 is a permanent magnet motor. Other types of motors may be used in alternative embodiments, such as an induction motor.

The control module 120 includes electronic components configured to control and drive the motor 182. The electronic components may be mounted on a circuit board 188 housed within the motor housing 180. In an exemplary embodiment, the control module 120 includes a controller 190 that operates the motor 182 in accordance with a control scheme. The control module 120 includes a power converter 192. The control module 120 includes a drive component 194 that controls the motor 182.

The drive component 194 is coupled to the controller 190 and operated based on the control scheme established by the controller 190. In an exemplary embodiment, the drive component 194 is a variable frequency drive, and may be referred hereinafter as variable frequency drive 194. The variable frequency drive 194 controls the rotational speed of the motor 182 by controlling the frequency of the electrical power supplied to the motor 182. By controlling the speed of the motor 182, the pressure of the water output by the pump assembly 102 may be controlled. For example, the motor 182 may drive the pump assembly 102 to maintain a constant pressure output condition from the pump assembly 102. The speed of the motor 182 may be constantly adjusted in order to maintain the constant pressure output condition.

In an exemplary embodiment, the control module 120 includes a bore-hole communication module 196. The bore-hole communication module 196 is communicatively coupled to the controller 190. The bore-hole communication module 196 is configured to be communicatively coupled to the communication module 140 (shown in FIG. 1). Data may be transmitted between the bore-hole communication module 196 and the communication module 140 at the surface 108 (shown in FIG. 1). In an exemplary embodiment, the communication module 140 transmits data along the power line 122, and the bore-hole communication module 196 is connected to the power line 122 to receive the data transmitted along the power line 122. Such data is communicated to the controller 190, such as to update the operating condition of the motor assembly 104. Similarly, the bore-hole communication module 196 may transmit data to the communication module 140, such as along the power line 122. In an alternative embodiment, a dedicated sensor cable may be provided between the communication module 140 and the bore-hole communication module 196, where data may be transmitted to and from the bore-hole communication module 196 and the communication module 140.

The sensor cable 132 may be electrically connected to the controller 190 such that the data from the sensor 170 may be transmitted to the controller 190. Optionally, the sensor cable 132 may be routed into the control module 120.

Figure 3:
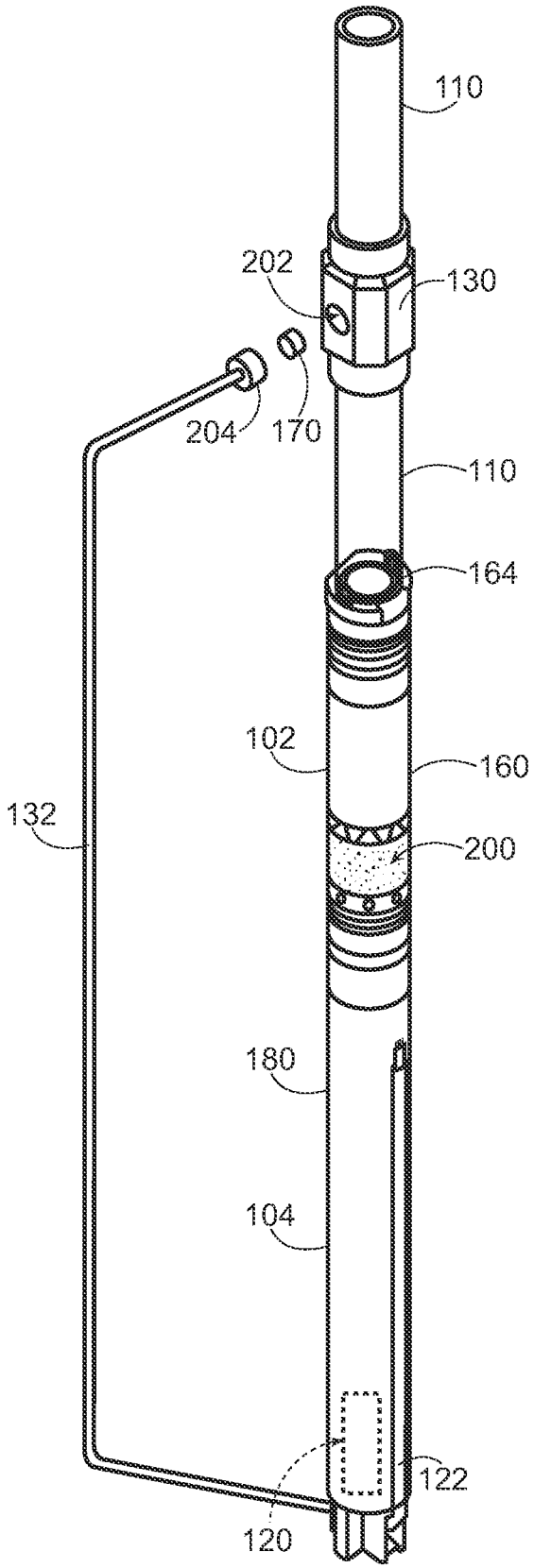
FIG. 3 is a perspective view of the pump assembly and motor assembly formed in accordance with an exemplary embodiment.

FIG. 3 is a perspective view of the pump assembly 102 and motor assembly 104 formed in accordance with an exemplary embodiment. The motor assembly 104 is coupled to the bottom of the pump assembly 102 and is positioned below the pump assembly 102 within the bore-hole 106 (shown in FIG. 1). The pump housing 160 includes inlets 200 that allow the fluid to enter the pump assembly 102. The piping 110 is coupled to the discharge end 164 of the pump assembly 102. In the illustrated embodiment, the sensor module 130 is positioned along the piping 110 proximate to the pump assembly 102. The sensor module 130 is spaced apart from the discharge end 164. The sensor module 130 includes an opening 202 that receives the sensor 170 therein. A plug 204 is received in the opening 202 to close the opening 202 from water ingress. The sensor cable 132 extends through the plug 204 and is routed down the bore-hole 106 to the control module 120. The power line 122 is also connected to the control module 120.

The pump assembly 102 and motor assembly 104 are coupled together. For example, the pump housing 160 is mounted to the motor housing 180. The pump housing 160 and the motor housing 180 may have similar or different outer diameters.

Figure 4:
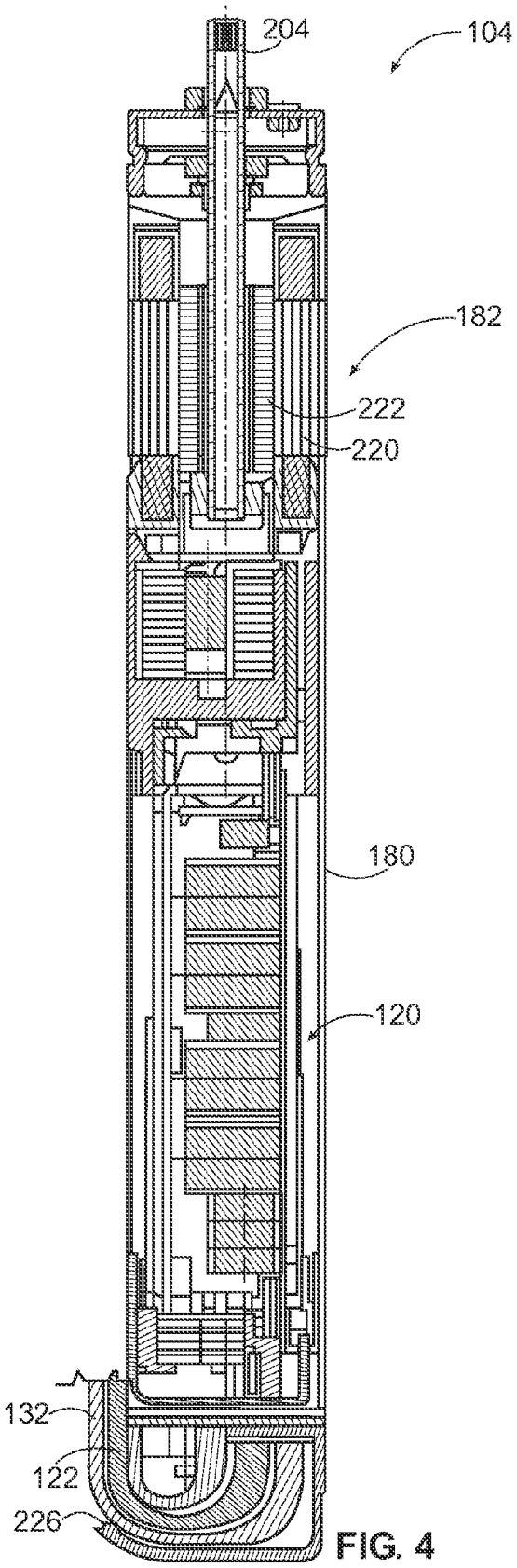
FIG. 4 is a cross-sectional view of the motor assembly formed in accordance with an exemplary embodiment.

FIG. 4 is a cross-sectional view of the motor assembly 104. The motor assembly 104 includes the motor 182 held within the motor housing 180. The motor 182 includes a stator 220 and a rotor 222. The motor 182 also includes a motor shaft 224. Power is supplied to the stator 220 to drive the rotor 222 and the motor shaft 224.

The control module 120 is housed within the motor housing 180. The power line 122 comes into the motor housing 180 through a port 226, which is sealed. The power line 122 delivers power to the control module 120, which controls the power supply to the motor 182. The sensor cable 132 also comes into the motor housing 180 through the port 226. The sensor cable 132 delivers signals to the control module 120 from the sensor module 130 (shown in FIG. 3), which is maintained down in the bore hole with the motor assembly 104. The control module 120 may control the power supply to the motor 182 based on the signals from the sensor module 130.

Figure 5:
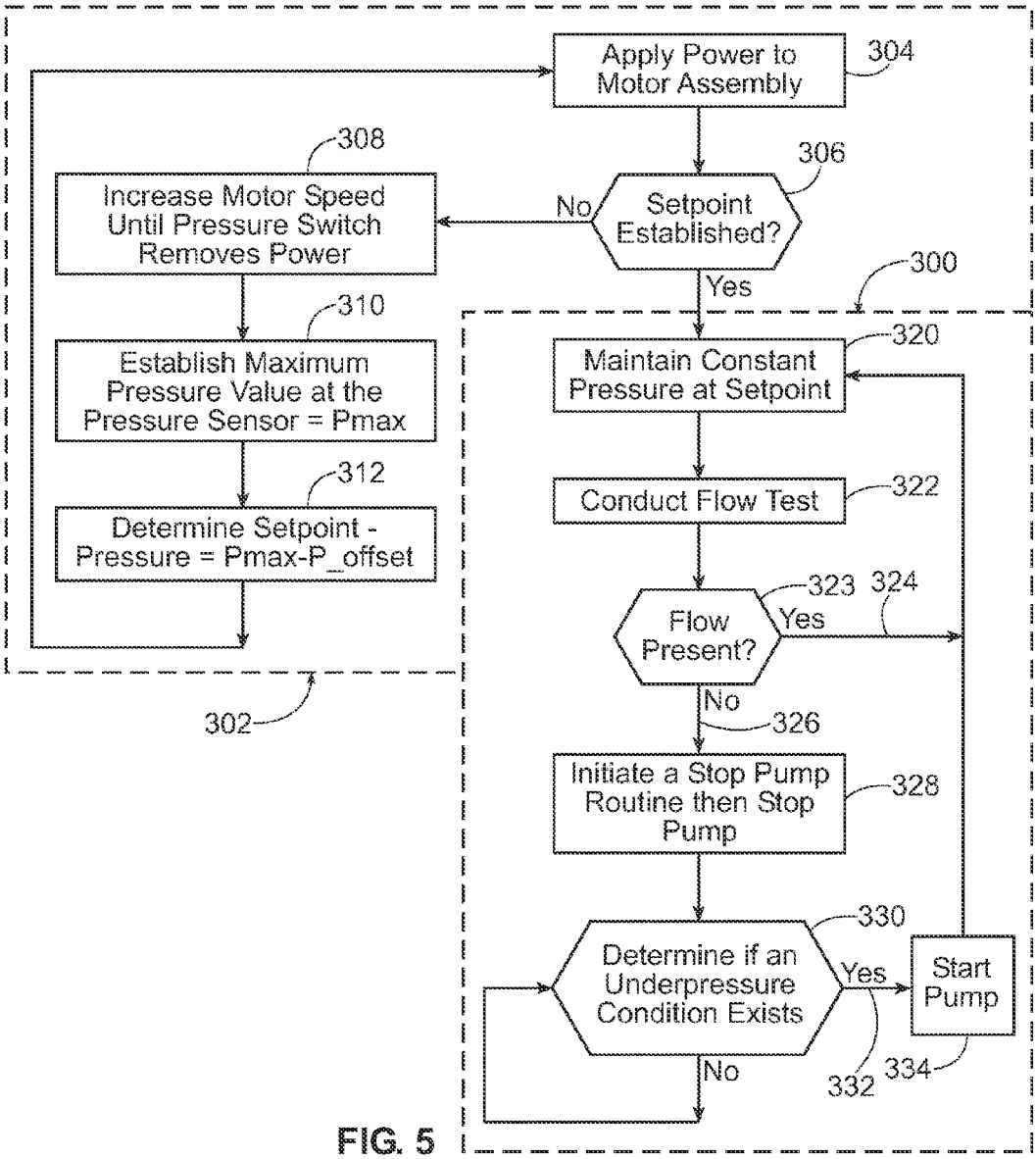
FIG. 5 is a flow chart showing an exemplary method of operation of the pump system.

FIG. 5 is a flow chart showing an exemplary method of operation of a constant pressure pump system. For example, the method of operation may be utilized with the pump system 100 (shown in FIGS. 1-4) incorporating the various components of the pump system 100, which are shown in FIGS. 1-4. While the method is described with reference to the pump system 100, it is realized that the method may be utilized with a different pump system having one or more different components than the pump system 100 in alternative embodiments.

The flow chart illustrates a method 300 of operating the pump system 100 to maintain a constant pressure output condition from the pump assembly 102. The flow chart also illustrates a method 302 of calibrating the pump system 100 by determining the constant pressure setpoint for the pump system 100.

The pump system 100 is operated by applying 304 power to the motor assembly 104. The power is transmitted from the power source 124 through the power line 122 to the control module 120. The control module 120 controls the power supply to the motor 182 in accordance with a particular control scheme.

Upon receiving power, the control module 120 determines 306 if a setpoint has been established. When the pump system 100 is first in use or when the pump system 100 has been reset, no setpoint is established. Furthermore, when a user changes a control parameter, the previous setpoint may be deleted and a new setpoint may need to be established. For example, when the user requests an increase or a decrease in the pressure of the water supplied by the pump system 100, such as using the remote control 142, the control module 120 may reset the system and reestablish an operating setpoint overriding the established setpoint.

When the control module 120 determines that no setpoint is established, the control module 120 may automatically calibrate the pump system 100 to establish a constant pressure setpoint using the method 302 of calibrating the pump system 100. The control module 120 slowly increases 308 the speed of the motor 182 until the pressure switch 144 removes power from the pump system 100. The pressure switch 144 may be configured to shut off the power supply from the power source 124 to the power line 122 at a predetermined water pressure within the piping 110 at the use point 112. The pressure switch 144 may thus operate as a safety device to protect the components of the pump system 100 and/or the plumbing components within the building, such as the plumbing lines and/or plumbing fixtures within the building. For example, the pressure switch 144 may be configured to shut off the power supply at 60 psi, which represents the maximum pressure at the use point 112 allowed by the pump system 100. Different pressures other than 60 psi may be allowed in other embodiments.

The control module 120 establishes 310 a maximum pressure value as measured at the pressure sensor 170 within the bore-hole 106 based on the shut off condition. The control module 120 establishes such maximum pressure value ($P_{max}$) by measuring a maximum pressure sensed by the pressure sensor 170 at the time when the power supply is shut off by the pressure switch 144. The measured maximum pressure value ($P_{max}$) correlates to the predetermined maximum pressure allowed by the pressure switch 144 at the use point 112. The measured maximum pressure value ($P_{max}$) within the bore-hole 106 at the pressure sensor 170 will be greater than the predetermined cutoff pressure of the pressure switch 144. The higher pressure value measured at the pressure sensor 170 is due to the added pressure from the column of water that fills the piping 110 above the pressure sensor 170. Because the column of water adds an unknown amount of pressure to the reading of the pressure sensor 170, the control module 120 runs the calibration sequence to establish an end use pressure setpoint for operating the motor assembly 104 in constant pressure mode.

The control module 120 determines 312 a setpoint pressure ($P_{setpoint}$) based on the measured maximum bore-hole pressure ($P_{max}$) measured by the pressure sensor 170 at the time when the power is shut off by the pressure switch 144. In an exemplary embodiment, the control module 120 has a predetermined pressure offset value ($P_{offset}$). In an exemplary embodiment, the pressure offset ($P_{offset}$) may be 10 psi. The pressure offset ($P_{offset}$) may be different in alternative embodiments. Such offset value may be stored in memory within the control module 120. The offset value may be adjustable or configurable by the user, such as at the control module 140 and/or the remote control 142. The control module 120 determines the end use setpoint pressure ($P_{setpoint}$) by subtracting the pressure offset from the maximum bore-hole pressure ($P_{max}-P_{offset}$). The end use setpoint pressure ($P_{setpoint}$) that the pump system 100 is operated at is less than the maximum pressure at which the pressure switch 144 will shut off power to the motor assembly 104. As such, the control module 120 is able to maintain a constant pressure output condition for the pump assembly 102 without the pressure switch 144 removing power from the motor assembly 104.

Once the setpoint pressure ($P_{setpoint}$) is determined, the pump system 100 may be operated normally in accordance with the method 300. During operation, the pump system 100 applies 304 power to the motor assembly 104 from the power source 124 via the power line 122. Because the setpoint pressure ($P_{setpoint}$) has been established by the control module 120, the pump system 100 is operated according to a normal control scheme. The control module 120 operates 320 the motor 182 to maintain a constant pressure output condition from the pump assembly 102 at the bore-hole setpoint pressure ($P_{setpoint}$). The constant pressure output condition may be a particular pressure value, or alternatively, may be a range of pressure values. For example, in order to maintain a constant pressure output condition, the pump system 100 may be operated to maintain the pressure of the water pumped from the pump assembly 102 within a pressure range of +/−X psi from the setpoint pressure ($P_{setpoint}$).

In an exemplary embodiment, the user may desire a pressure of 50 psi within the plumbing system in the building. A pressure of 50 psi at the surface may correspond a pressure of 70 psi within the bore-hole 106 at the output of the pump assembly 102. As such, the setpoint pressure measured by the pressure sensor 170 may be established at 70 psi using the calibration method 302. The control module 120 drives the motor 182 to maintain a constant pressure output condition from the pump assembly 102 by maintaining the pressure measured by pressure sensor 170 at between 65 psi and 75 psi. In such situations, the constant pressure output condition has a range 10 psi. The constant pressure output condition may have a different range in alternative embodiments. For example, the constant pressure output condition may have a smaller range, such as a range of approximately 4 psi, wherein the control module 120 operates the motor 182 to have the pump assembly 102 maintain the pressure readings at the pressure sensor 170 between 68 and 72 psi.

In an exemplary embodiment, the control scheme of the control module 120 may be based on the presence or absence of flow within the plumbing system of the building. For example, the pump system 100 may operate differently when flow is present than when flow is absent. During operation, the pump system 100 conducts 322 a flow test to determine 323 if flow is present. In an exemplary embodiment, the pump system 100 uses the pressure sensor 170 to determine if flow is present. For example, the motor 182 and pump assembly 102 speed may be reduced and the pressure measured. If the measured pressure is decreasing with the motor 182 speed reduced, then the control module 120 determines that flow is present within the plumbing system. However, if the measured pressure remains constant, then the control module 120 determines that flow is absent within the plumbing system. When the pressure monitored at the pressure sensor 170 drops, such drop in pressure may correspond with flow in the system. For example, when a valve at a fixture is opened, the pressure within the plumbing system and the piping 110 will drop, and such drop in pressure is sensed at the pressure sensor 170. Such drop in pressure may cause the control module 120 to start the motor 182 to maintain the constant pressure output condition.

In an alternative embodiment, the pump system 100 may utilize a different method or components to determine if flow is present. For example, the pump system 100 may include a flow sensor for determining when flow is present. The flow sensor may be provided within the sensor module 130. The flow sensor may be positioned elsewhere within the pump system 100 in alternative embodiments. The flow sensor may be positioned downstream of the use point 112, such as in the plumbing system within the building. The flow sensor is communicatively coupled to the control module 120. For example, the flow sensor may be connected to the control module 120 by the sensor cable 132. Alternatively, the flow sensor may be connected to the control module 120 via the power line 122. In such situations, the flow sensor may communicate with the communication module 140, and data relating to the condition of the flow sensor may be transmitted to the control module 120 by the power line 122 or by a dedicated sensor cable between the communication module 140 and the control module 120.

In the situation where flow is present 324, the control module 120 is operated 320 to maintain the constant pressure output condition. The control module 120 controls the motor 182 to maintain the constant pressure output condition. The control module 120 utilizes the readings from the pressure sensor 170 to drive the motor 182 at a speed such that the pump assembly 102 delivers water at a pressure that is at, or within a range of, the setpoint pressure ($P_{setpoint}$). The control module 120 operates in accordance with such control scheme during the time period in which flow is present. The control module 120 may periodically conduct 322 flow tests to determine 323 when flow is present.

In an exemplary embodiment, after the flow test is conducted and the control module 120 determines that no flow is present 326, the control module 120 will stop the motor 182 in accordance with a control scheme. In an exemplary embodiment, the control module 120 initiates 328 a stop pump routine in which the control module 120 operates the motor 182 to boost the pressure within the piping 110 above setpoint pressure. For example, the control module 120 may operate the motor 182 to drive the pump assembly 102 to increase the pressure within the piping 110 to a boost value ($P_{boost}$), which may be equal to the setpoint pressure ($P_{setpoint}$) plus a predetermined amount. For example, the boost pressure ($P_{boost}$) may be equal to the setpoint pressure ($P_{setpoint}$) plus 7 psi. Other boost ($P_{boost}$) values are possible in alternative embodiments. Once the boost pressure ($P_{boost}$) value is reached, the control module 120 stops the motor 182.

The control module 120 continues to monitor the pressure within the piping 110 at the pressure sensor 170. While the pump is in the off condition, the control module 120 determines 330 if an under-pressure condition occurs. If the under-pressure condition does not occur, the method will continue to loop to determine 330 if the under-pressure condition occurs. The control module 120 will continuously or periodically sample the pressure at the pressure sensor 170 until the under-pressure condition is detected. An under-pressure condition may exist when the pressure measured by the pressure sensor 170 is a predetermined amount below the setpoint pressure ($P_{setpoint}$). For example, when the pressure is less than ($P_{setpoint}$)−4 psi, an under-pressure condition exists. If an under-pressure condition exists 332, the control module 120 will start 334 the motor 182 to increase the pressure to ($P_{setpoint}$) by operating the pump assembly 102 in constant pressure mode. Once the control module 120 starts the motor 182, the normal operation continues. The control module 120 conducts 322 a flow test to determine 324 if flow is present. If no flow is present 326, then the control module 120 operates the motor 182 until the boost pressure is achieved and then the motor 182 will again be stopped until the under-pressure condition is met.

The methods 300, 302 are merely illustrative of an exemplary control and calibration operation of the pump system 100. The pump system 100 may be operated differently in alternative embodiments to maintain a constant pressure condition. The pump system 100 may be operated according to other control schemes other than a constant pressure control scheme in alternative embodiments. While the control module 120 may be operated based on a pressure reading from the pressure sensor 170 proximate to the output of the pump assembly 102, the control module 120 may be operated based on other water parameters (e.g. temperature, flow rate, etc.) and/or based on readings taken from other locations within the pump system in addition to, or in the alternative to, the pressure sensor 170 in alternative embodiments.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. A submersible pump system comprising:

a pressure switch configured to measure a surface pressure of a fluid in piping proximate to a use point of the fluid in the piping;

a power source having a power line extending therefrom, the power source configured to shut off power to the pump when a maximum pressure condition is detected at the pressure switch;

a submersible pump assembly having one or more stages of impellers, the pump assembly having a discharge fitting configured to be connected to the piping;

a pressure sensor measuring a pressure of fluid directed through the discharge fitting into the piping, the pressure sensor being positioned above the discharge fitting in proximity to the submersible pump assembly and remote from the pressure switch, the pressure at the pressure sensor being greater than the surface pressure; and a submersible motor assembly driving the pump assembly, the motor assembly having a motor housing, a motor within the motor housing for driving the pump assembly and a control module for operating the motor, the control module being electrically connected to the power line, the control module being electrically connected to the pressure sensor by a sensor cable entirely submerged with the submersible pump assembly and submersible motor assembly, the control module comprising a controller and a variable frequency drive driven by the controller based on pressure data from both the pressure switch and the pressure sensor;

wherein the controller is calibrated by measuring the pressure sensed by the pressure sensor at a time when the power source is shut off when the maximum pressure condition is detected by the pressure switch; and wherein the controller operates the variable frequency drive to drive the motor to maintain a constant pressure output condition from the pump assembly at a pressure that is a fraction of the measured pressure sensed at the time when the power source is shut off when the maximum pressure condition is detected by the pressure switch.

2. The submersible pump system of claim 1, wherein the controller is programmed with an offset pressure, the controller operates the variable frequency drive to drive the motor at a setpoint pressure that is equal to the pressure sensed by the pressure sensor at the time when the power source is shut off when the maximum pressure condition is detected by the pressure switch less the offset pressure.

3. The submersible pump system of claim 1, wherein the control module is submersible with the motor and the motor housing.

4. The submersible pump system of claim 1, wherein the control module is housed within the motor housing.

5. The submersible pump system of claim 1, wherein the pressure sensor is submersible and positioned above the pump assembly.

6. The submersible pump system of claim 1, wherein the controller is configured to turn on, turn off, speed up or slow down the motor based on the pressure sensed by the pressure sensor to maintain the constant pressure output condition.

7. The submersible pump system of claim 1, wherein the controller controls a power supply to the motor.

8. The submersible pump system of claim 1, wherein the motor comprises a permanent magnet motor.

9. The submersible pump system of claim 1, further comprising a communication module spatially separated from the control module, the communication module configured to be electrically connected to the power line, the communication module configured to transmit data to the control module via the power line, the controller configured to receive the data transmitted via the power line.

10. The submersible pump system of claim 9, wherein the communication module comprises a remote control and a receiver communicating with the remote control, the receiver being configured to be electrically connected to the power line to transmit data received from the remote control to the control module via the power line.

11. A method of operating a submersible pump system comprising:

providing a pressure switch and a power supply at a surface, the pressure switch measuring a pressure of fluid in piping, wherein the pressure switch is operably coupled to the power supply to shut off the power supply when a pressure switch maximum pressure is detected;

providing a pressure sensor, a pump assembly and a motor assembly submerged in a bore-hole or storage tank, the motor assembly having a motor and a control module for operating the motor, the control module being electrically connected to the power supply by a power line, the control module being electrically connected to the pressure sensor by a sensor cable, the control module having a controller and a variable frequency drive driven by the controller based on pressure data from the pressure sensor;

operating the motor at increasing speed to increase a pressure provided by the pump assembly until the pressure switch shuts off the power supply to the pump;

establishing a maximum pressure value sensed by the pressure sensor at a time when the power supply is shut off by the pressure switch when the pressure switch maximum pressure is detected;

determining a setpoint pressure by subtracting an offset pressure from the maximum pressure value sensed by the pressure sensor; and operating the motor to provide a constant pressure output condition from the pump assembly at the setpoint pressure.

12. The method of claim 11, wherein said operating the motor comprises conducting a flow test to determine if flow is present or absent and initiating a stop pump operation when flow is absent to stop the pump assembly from pumping fluid.

13. The method of claim 12, wherein said initiating the stop pump operation comprises boosting the pressure in the pipe to a boost pressure and stopping the pump assembly when the boost pressure is reached.

14. The method of claim 12, wherein after the pump assembly is stopped, the method further comprises monitoring the pressure at the pressure sensor to determine if an under-pressure condition occurs, and when the under-pressure condition occurs, the method further comprises initiating a start pump operation.

15. A submersible pump system comprising:

a power supply at a surface, the power supply having a power line extending therefrom to a submersible motor assembly;

a pressure switch at a surface, the pressure switch measuring a surface pressure of a fluid in piping proximate to a use point of the fluid in the piping, the pressure switch being operably coupled to the power supply to shut off the power supply when a pressure switch maximum pressure is detected in the piping;

a submersible pump assembly submerged in a bore hole or storage tank, the pump assembly having one or more stages of impellers;

a pressure sensor submerged in the bore hole or storage tank, the pressure sensor measuring a pressure of fluid in the piping proximate to the pump assembly; and the submersible motor assembly submerged in the bore hole or storage tank, the motor assembly being electrically connected to the pressure sensor by a sensor cable, the motor assembly having a motor for driving the pump assembly and a control module for operating the motor, the control module being operable in a calibration mode and in a constant pressure mode;

in the calibration mode, the control module operating the motor at increasing speed to increase the pressure provided by the pump assembly until the pressure switch shuts off the power supply to the pump assembly, the control module establishing a maximum pressure value sensed by the pressure sensor at a time when the power supply is shut off by the pressure switch when the pressure switch maximum pressure is detected, the control module determining a setpoint pressure, less than the maximum pressure value, by subtracting an offset pressure from the maximum pressure value sensed by the pressure sensor;

in the constant pressure mode, the control module operating the motor to provide a constant pressure output condition from the pump assembly at the setpoint pressure.

16. The submersible pump system of claim 15, wherein the control module comprises a controller and a variable frequency drive driven by the controller based on pressure data from the pressure sensor.

17. The submersible pump system of claim 16, wherein the controller operates the variable frequency drive to drive the motor to maintain a constant pressure output condition from the pump assembly at the setpoint pressure that is a fraction of the maximum pressure value sensed at the pressure sensor when the power source is shut off by the pressure switch.

18. The submersible pump system of claim 15, wherein the setpoint pressure is between approximately 50% and 99% of the maximum pressure value.

19. The submersible pump system of claim 15, wherein the setpoint pressure is between approximately 90% and 99% of the maximum pressure value.

20. The submersible pump system of claim 15, wherein the offset pressure is between approximately 1% and 10% of the maximum pressure value.

21. The submersible pump system of claim 15, wherein the control module is submersible with the motor in a motor housing.

22. The submersible pump system of claim 15, wherein the pressure sensor is positioned at a discharge fitting of the pump assembly.

23. The submersible pump system of claim 15, wherein the control module conducts flow tests to determine if flow is present or absent and initiates a stop pump operation when flow is absent to stop the pump assembly from pumping fluid.

24. The submersible pump system of claim 23, wherein the control module boosts the pressure in the pipe to a boost pressure higher than the setpoint pressure but lower than the maximum pressure value during the stop pump operation and the control module stops the pump assembly when the boost pressure is reached.

25. The submersible pump system of claim 15, wherein after the pump assembly is stopped, the control module monitors the pressure at the pressure sensor to determine if an under-pressure condition occurs, and when the under-pressure condition occurs, the control module initiates a start pump operation.

26. The submersible pump system of claim 25, wherein the control module has an under-pressure value that is less than the setpoint pressure, the control module determines that the under-pressure condition occurs when the pressure sensed by the pressure sensor is at or below the under-pressure value.

27. The submersible pump system of claim 25, wherein the control module has an under-pressure value that is less than the setpoint pressure, the control module determines that the under-pressure condition occurs when the pressure sensed by the pressure sensor is at or below the under-pressure value.

28. The submersible pump system of claim 15, wherein the control module is configured to turn on, turn off, speed up or slow down the motor based on the pressure sensed by the pressure sensor to maintain the constant pressure output condition.

29. The submersible pump system of claim 15, wherein the control module controls a power supply to the motor.

30. The submersible pump system of claim 15, wherein the motor comprises a permanent magnet motor.

31. The submersible pump system of claim 15, further comprising a communication module spatially separated from the control module, the communication module configured to be electrically connected to the power line, the communication module configured to transmit data to the control module via the power line, the controller configured to receive the data transmitted via the power line.

32. The submersible pump system of claim 31, wherein the communication module comprises a remote control and a receiver communicating with the remote control, the receiver being configured to be electrically connected to the power line to transmit data received from the remote control to the control module via the power line.

* * * * *